US005564695A

United States Patent [19]

Christensen

[11] Patent Number: 5,564,695

[45] Date of Patent: Oct. 15, 1996

[54] BREAK-AWAY BASE

[76] Inventor: Arthur E. Christensen, 1316 Dulaney Valley Rd., Towson, Md. 21286

[21] Appl. No.: 584,739

[22] Filed: Jan. 11, 1996

[51] Int. Cl.[6] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 2,405,492 | 8/1946 | Corbett | 273/25 |
| 3,572,705 | 3/1971 | Wyble | 273/25 |
| 3,862,756 | 1/1975 | Selliken | 273/25 |
| 3,938,804 | 2/1976 | Willett | 273/25 |
| 4,266,768 | 5/1981 | Hall | 273/25 |
| 4,723,779 | 2/1988 | Hauser | 273/25 |
| 4,979,740 | 12/1990 | Hall | 273/25 |
| 5,080,356 | 1/1992 | Green et al. | 273/25 |
| 5,290,028 | 3/1994 | Bartoli | 273/25 |
| 5,415,394 | 5/1995 | Hall | 273/25 |

*Primary Examiner*—William H. Grieb
*Attorney, Agent, or Firm*—Leonard Bloom

[57] ABSTRACT

A break-away base for preventing injuries to baseball players, particularly when sliding into the base. The break-away base has a generally-square first portion and has four sides, each of which is bent downwardly and outwardly to provide an inclined face portion which is disposed upwardly and away from the baseball player when the player is sliding into the base. The first portion is fixedly mounted in the ground, such that a greater part of the respective inclined faces are below the ground level. A second generally-square portion is disposed on top of the first portion and substantially aligned therewith. The first portion and the second portion are magnetically attracted to one another with a sufficient force to prevent inadvertent dislodgement therefrom but insufficient to prevent the second portion faces being slid away from the first portion when a player vigorously slides into the base.

11 Claims, 6 Drawing Sheets

BREAK-AWAY BASE

STATEMENT REGARDING FEDERALLY SPONSORED RESEARCH OR DEVELOPMENT (Not applicable.)

CROSS REFERENCE TO RELATED APPLICATIONS (Not applicable.)

REFERENCE TO A MICROFICHE APPENDIX SPECIFYING THE TOTAL NUMBER OF MICROFICHE AND TOTAL NUMBER OF FRAMES (Not applicable.)

BACKGROUND OF THE INVENTION

In playing the game of baseball, the runner frequently slides into one of the bases to avoid being tagged "out" when a ball is thrown to a player for the opposing team who is waiting at the base. The foot of the sliding player sometimes becomes lodged against the base which is fixed in the ground and the sliding player is injured. The injury may be a twisted leg, ankle or foot or even a broken bone. It has been estimated that, in little league and playground baseball, approximately ninety percent (90%) of the injuries are due to sliding into fixed bases. These injuries also occur with professional baseball players. U.S. Pat. No. 2,405,492, to Corbett discloses a base which is releasably secured to an anchor. The base does not break-away when a player slides into the base. U.S. Pat. No. 3,862,756 to Selliken discloses a base having a first member mounted flush with the ground and a second member magnetically held on the first member. The members are further formed with engaging ribs and grooves to assist in holding the members in place. The second member is dislodged when hit forcefully by a player. Hall, in U.S. Pat. No. 4,266,768 discloses a break-away base which has hook and loop fastening means to connect the base portion to the flush mounted support portion. U.S. Pat. No. 4,723,779 to Hauser and U.S. Pat. No. 5,290,028 to Bartoli, both disclose anchored bases with tapered sides.

Despite the existence of these prior art devices, there are still a large number of baseball players suffering injuries due to bases which are not dislodged when the player forcefully contacts the base. There is a need for a base which has a fixed member with inclined sides that, should the player's foot go beneath the ground level, directs the player's foot against the moveable member and assists in dislodgement of the moveable member.

BRIEF SUMMARY OF THE INVENTION

The object of the present invention is to provide a break-away base for the game of baseball which has an anchored member with inclined sides which is magnetically connected to a moveable member.

A further object of the present invention is to provide a break-away base for the game of baseball which has a moveable member which is dislodged when a player slides into the base.

In accordance with the teachings of the present invention, there is disclosed a break-away base for preventing injuries to baseball players, particularly when sliding into the base. The base is a generally-square first portion having four sides, each of which is bent downwardly and outwardly to provide an inclined face portion which is disposed upwardly and away from the baseball player when the player is sliding into the base. The base further has means for fixedly mounting the first portion to the ground, such that a greater part of the respective inclined faces are below the ground level. A second generally-square portion is movably disposed on top of the first portion and substantially aligned therewith. The second portion has a flat bottom and further has sides which are substantially perpendicular to the bottom. One of said portions carries magnet means thereon, the other of said portions is made of a magnetically susceptible material wherein the portions are magnetically attracted to one another at an interface between said portions with a sufficient force to prevent inadvertent dislodgement therefrom but insufficient to prevent the second portion from being slid away from the first portion when the player vigorously slides into the base. In this manner, serious injury to the player is prevented, yet allowing the player to maintain contact with at least the first portion of the base and preventing overrunning the base and being tagged "out". Furthermore, the attraction between the first portion and the second portion is unaffected by dirt adhering to the portions.

These and other objects of the present invention will become apparent from a reading of the following specification taken in conjunction with the enclosed drawings.

DESCRIPTION

Figure 1:
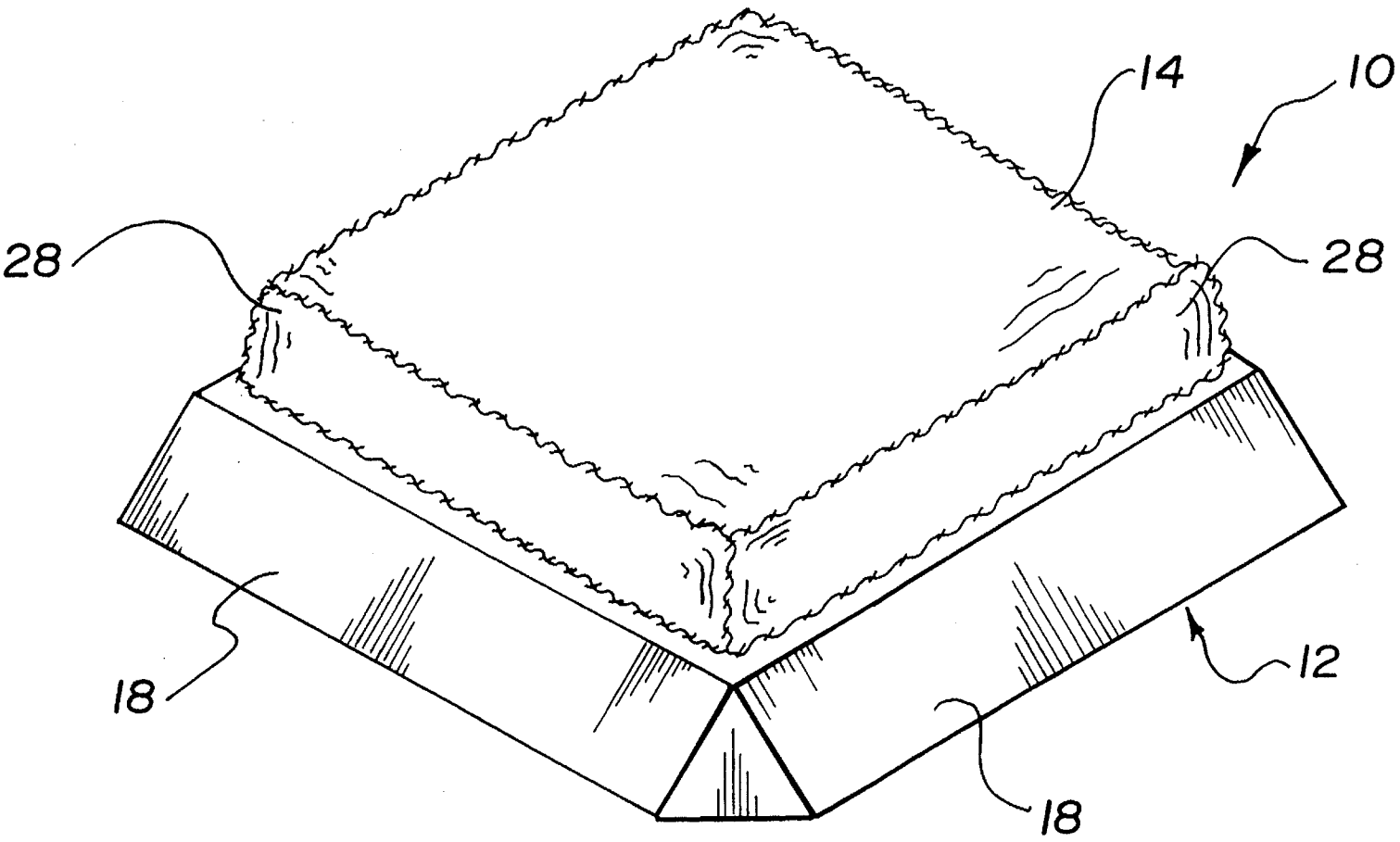
FIG. 1 is a perspective view of the break-away base of the present invention.
Figure 2:
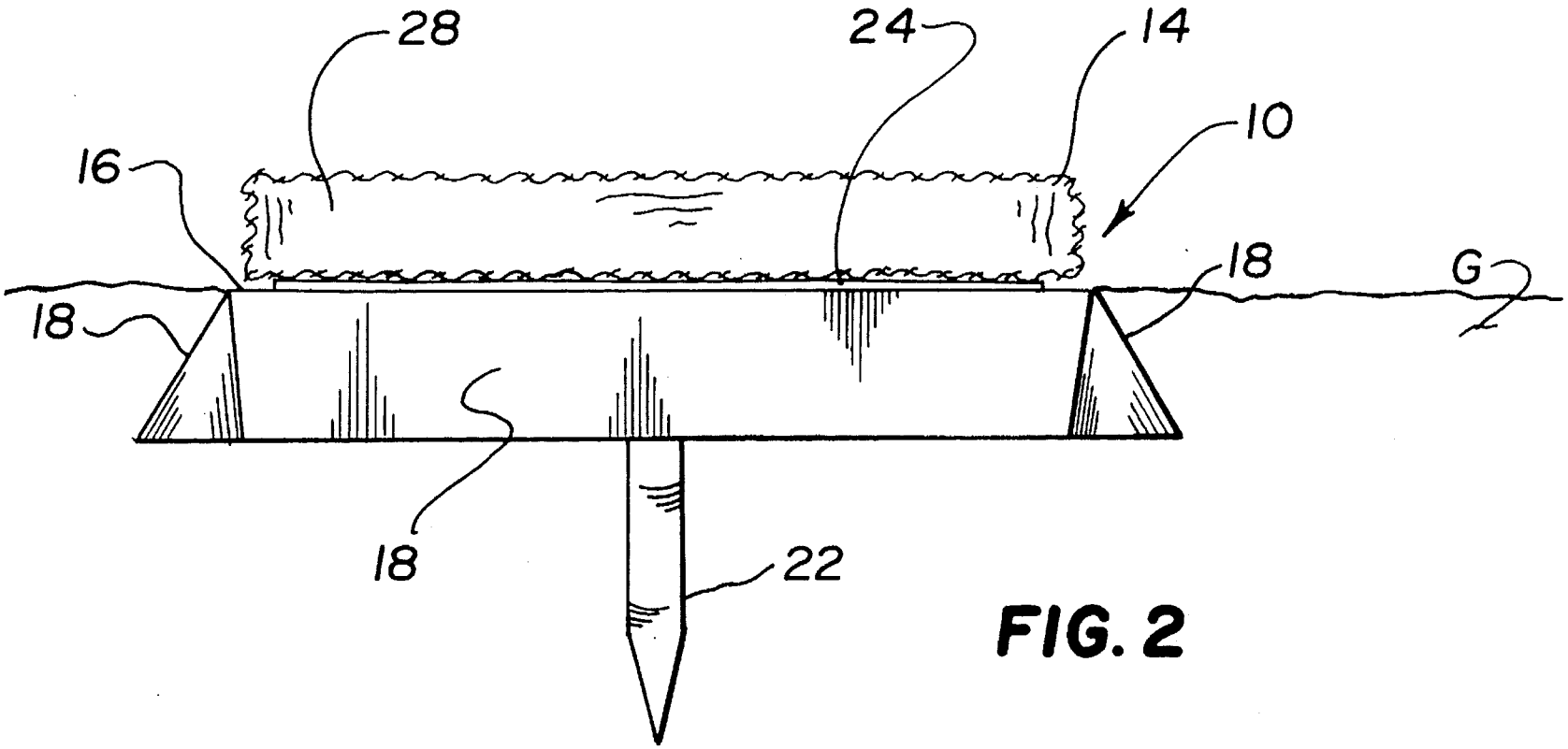
FIG. 2 is a side view of the break-away base of the present invention showing the base emplaced in the ground.
Figure 3:
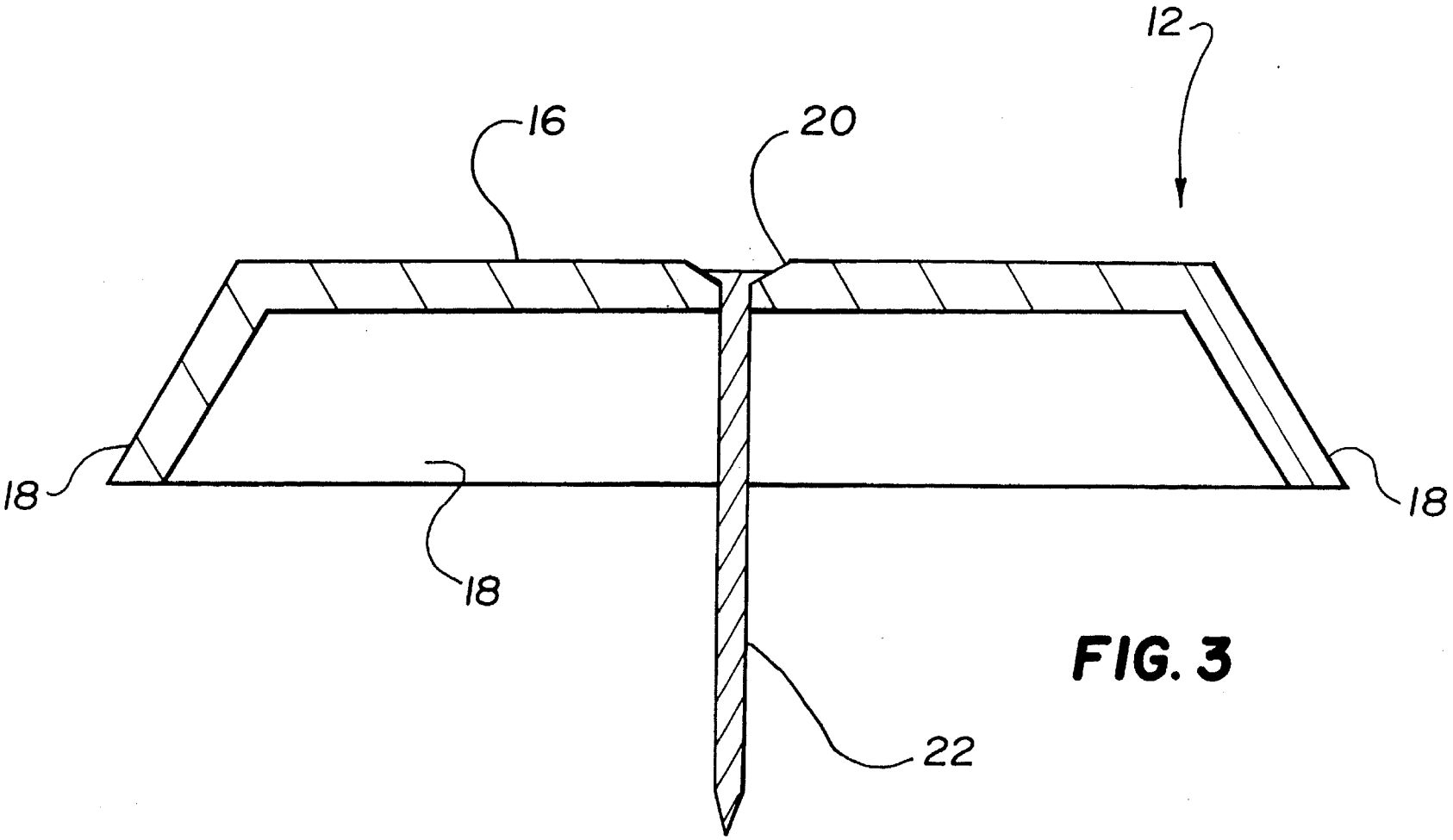
FIG. 3 is a cross-sectional view of the first portion of the base showing the recessed area in the top surface of the first portion and the spike attached thereto.
Figure 4:
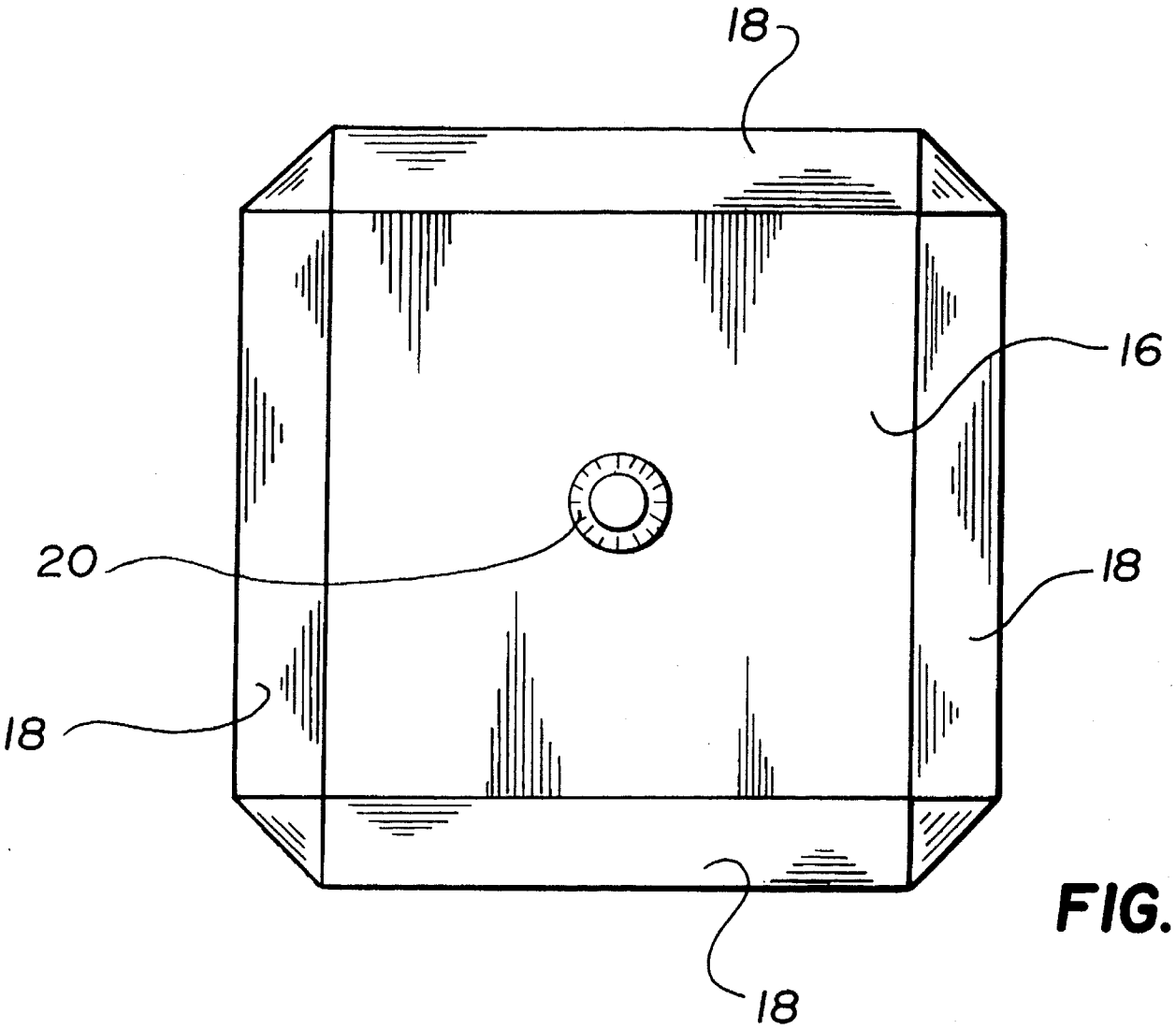
FIG. 4 is a top plan view of the first portion of the base.

Referring now to FIGS. 1 and 2, the break-away base 10 has a generally square first portion 12 and a generally square second portion 14 disposed on top of the first portion 12. The first portion 12 has a top surface 16 and four sides 18. Each side is bent downwardly and outwardly from the top surface 16 such that an inclined face surface is formed about the top surface 16 of the first portion 12 (FIGS. 2–4). The first portion 12 is fixedly mounted in the ground G with the top surface 16 approximately flush with, or slightly above, the surface of the ground G. When the top surface 16 of the first portion 12 is flush with the ground G, the entirety of the respective inclined surfaces of the sides 18 are beneath the ground level. Alternately, the top surface 16 of the first portion 12 is disposed above the ground level G such that at least two-thirds of the respective inclined surfaces of the sides 18 are below the ground level G. In this manner, when a player slides into the base 10, the player's foot is directed toward the second portion 14 of the base 10. If the player's foot digs into the ground, the upwardly inclined surface directs the player's foot upwardly, out of the ground and against the side, of the second portion 14 and facilitates dislodgement of the second portion 14 as will be described. It is preferred that a recessed area 20 is formed approximately in the center of the top surface 16 of the first portion 16. A spike 22 is attached to the recessed area 20 so that the spike 22 is oriented approximately perpendicularly downward from the top surface 16. Alternately, an opening is formed in the recessed area 20 and the head of the spike 22 is disposed above the opening with the body of the spike 22 disposed below the top surface 16 of the first portion 12. Because the head of the spike 22 is in the recessed area 20, there are no projections above the top surface 16 of the first portion 12 and the second portion 14 is flush with the top surface 16 of the first portion 12. The spike 22 is driven into the ground G and the first portion 12 is thereby anchored in the desired location.

The first portion 12 is preferably made from a magnetically susceptible material such as iron or a plastic matrix having a plurality of iron particles dispersed therein. Alternately, the first portion 12 may have a magnet means 24 connected to the top surface 16 of the first portion 12.

Figure 5:
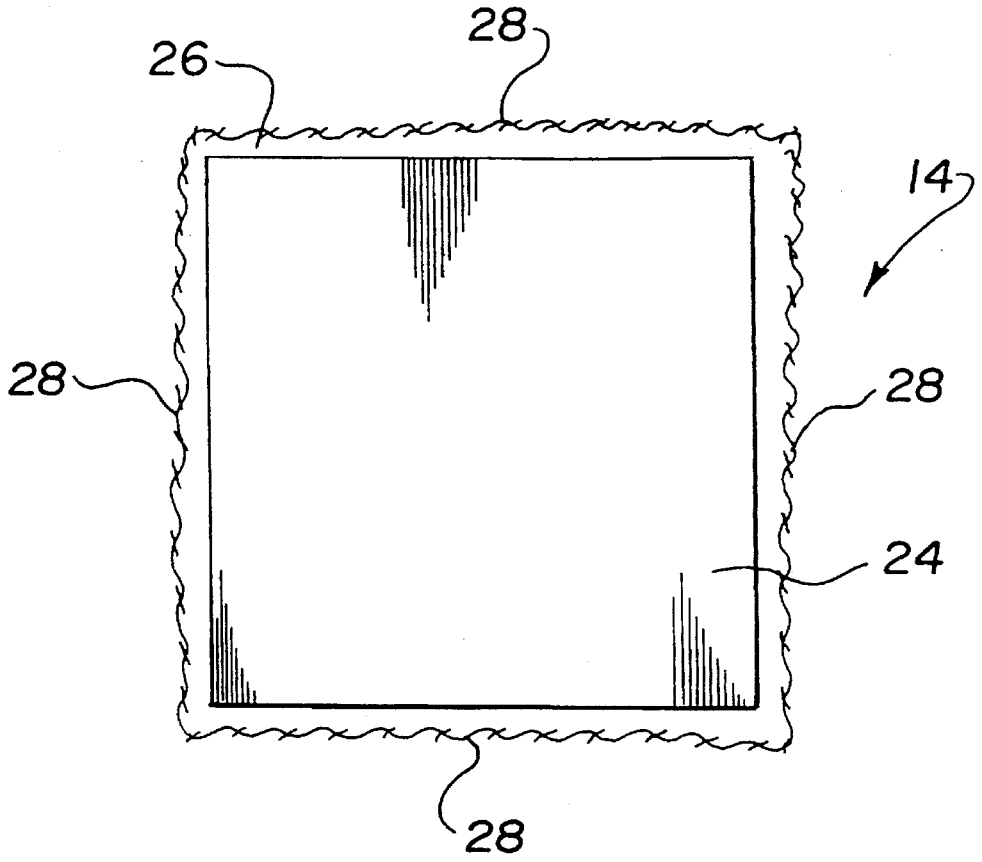
FIG. 5 is a bottom plan view of the second portion of the base.
Figure 6:
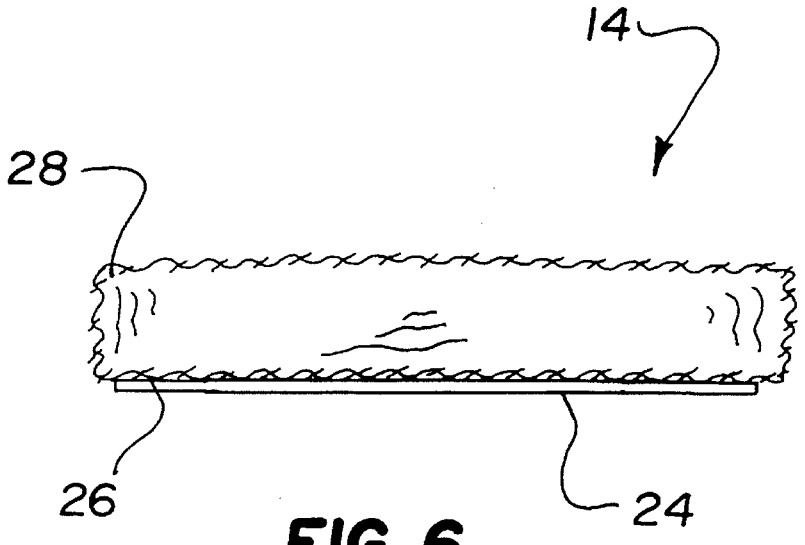
FIG. 6 is a side elevational view of the second portion of the base.

The second portion 14 is generally square and approximately the same size as the top surface 16 of the first portion 12. The second portion 14 has a flat bottom surface 26 and four sides 28. The four sides 28 are substantially perpendicular to the bottom surface 26 (FIGS. 5–6). It is preferred that a magnet means 24 be attached to the bottom surface 26 and cover substantially the entire bottom surface 26. The magnet means 24 may be a permanent magnet, a plastic matrix carrying particulates of magnetized metal or other magnets known to persons skilled in the art. Alternately, a panel or sheet of a plastic matrix containing a plurality of iron particles dispersed therein is attached to the bottom surface 26 of the second portion 14 and the magnet means 24 is attached to the top surface 16 of the first portion 12. In either embodiment, the first portion 12 and the second portion 14 are magnetically secured to one another at an interface between the portions with sufficient force to prevent inadvertent dislodgement of the second portion 14.

Figure 7:
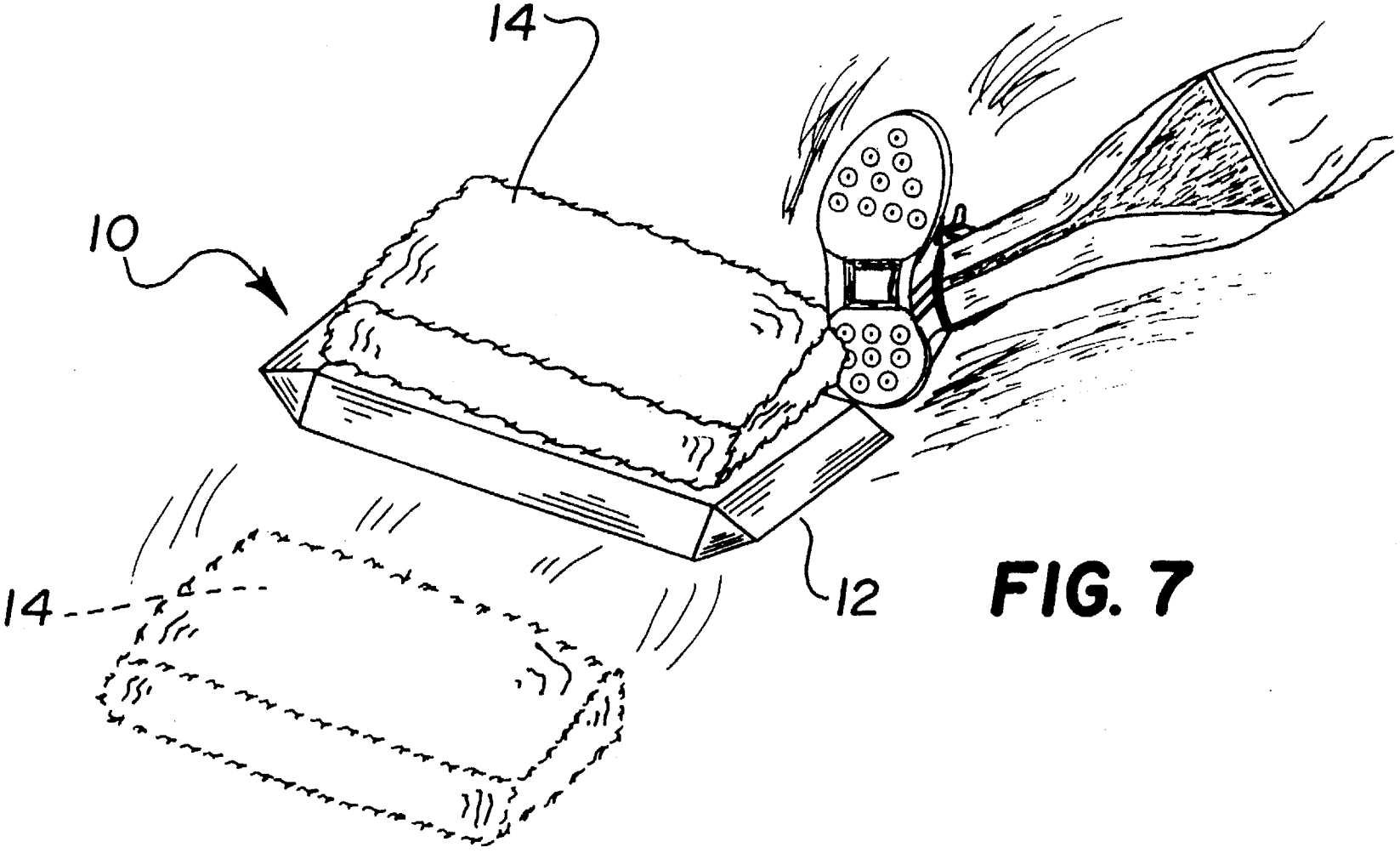
FIG. 7 is a perspective view showing a player sliding into the base and dislodging the second portion of the base.

When the break-away base 10 of the present invention is used in the game of baseball, the first portion 12 is anchored into the ground G at the desired location such as for use as 1st base, 2nd base or 3rd base. The sides 18 of the first portion are substantially below the ground level. The second portion 14 is movably disposed on top of the first portion 12 such that the second portion 14 is above the ground level and the second portion 14 is substantially aligned with the first portion 16. That is, the sides 28 of the second portion 14 are approximately parallel to the sides 18 of the first portion 12. The bottom 26 of the second portion 14 and the top surface 16 of the first portion 12 are magnetically secured to one another at the interface between the portions. In this manner, during the usual course of the ball game, the base 10 is indistinguishable from a base of the prior art. A runner steps on the second portion 14 when rounding the bases and a fielder steps on the second portion 14 to effect a "force out" of a runner. However, when a player vigorously slides into the base 10 of the present invention, the player's foot or hand is directed against the upright side 28 of the second portion 14 (FIG. 7). Sufficient force is directed against the second portion 14 to overcome the magnetic attraction and to dislodge the second portion 14 from the first portion 12.

Another important advantage of the present invention is that dirt has no detrimental effects on either the first portion 12 or the second portion 14 nor on the attractive forces which hold the portions. As distinguished from the hook and loop fasteners of the prior art, dirt is easily brushed off of the portions of the present invention and the portions are reattached to one another without delay or loss of attractive forces.

In the event that the player's foot or hand digs into the ground, the foot or hand engages the inclined side 18 of the first portion 12 and is directed upwardly, out of the ground and against the second portion 14. Thus, the sliding player avoids bending, twisting or otherwise injuring the player's foot or hand.

Obviously, many modifications may be made without departing from the basic spirit of the present invention. Accordingly, it will be appreciated by those skilled in the art that within the scope of the appended claims, the invention may be practiced other than has been specifically described herein.

I claim:

1. A break-away base for preventing injuries to baseball players, particularly when sliding into the base, comprising a generally-square first portion having four sides, each of which is bent downwardly and outwardly to provide an inclined face surface which is disposed upwardly and away from the baseball player when the player is sliding into the base, means for fixedly mounting the first portion to the ground, such that a greater part of the respective inclined faces are below the ground level, a second generally-square portion movably disposed on top of the first portion and substantially aligned therewith, the second portion having a flat bottom and further having sides which are substantially perpendicular to the bottom, one of said portions carrying magnet means thereon, the other of said portions being made of a magnetically susceptible material wherein the portions are magnetically attracted to one another at an interface between said portions with a sufficient force to prevent inadvertent dislodgement therefrom but insufficient to prevent the second portion from being slid away from the first portion when the player vigorously slides into the base, thereby preventing a serious injury to the player, yet allowing the player to maintain contact with at least the first portion of the base and preventing overrunning the base and being tagged "out" and further wherein, the attraction between the first portion and the second portion is unaffected by dirt adhering to the portions.

2. The base of claim 1, wherein the magnetically susceptible material is sheet metal.

3. The base of claim 1, wherein the magnetically susceptible material is a plastic matrix having iron particles dispersed therein.

4. The base of claim 1, wherein the first portion is made of a magnetically susceptible sheet metal and the magnetic means are carried by the bottom of the second portion.

5. The base of claim 1, wherein the means for fixedly mounting the first portion to the ground is a spike attached to approximately the center of the first portion.

6. The base of claim 5, the first portion having top surface, a recessed area being formed in approximately the center of the top surface, the spike being attached to the recessed area and being oriented approximately perpendicularly downwardly therefrom.

7. The base of claim 1, wherein the magnet means covers substantially all of the interface between the first portion and the second portion.

8. The base of claim 1, wherein the first portion has a top surface, the top surface being flush with the ground level such that the entirety of the respective inclined surfaces of the first portion are below the ground level.

9. The base of claim 1, wherein at least two-thirds of the respective inclined surfaces of the first portion are below the ground level.

10. A break-away base for preventing injuries to baseball players, particularly when sliding into the base, comprising a generally-square first portion having four sides, each of which is bent downwardly and outwardly to provide an inclined face surface which is disposed upwardly and away from the baseball player when the player is sliding into the base, the first portion having top surface, a recessed area being formed in approximately the center of the top surface, a spike being attached to the recessed area and being oriented approximately perpendicularly downwardly therefrom such that the first portion is fixedly mounted to the ground, such that a greater part of the respective inclined faces are below the ground level, a second generally-square portion movably disposed on top of the first portion and substantially aligned therewith at an interface therebetween, the second portion having a flat bottom and further having sides which are substantially perpendicular to the bottom, substantially all of the bottom of the second portion carrying magnet means thereon, the first portion being made of a magnetically susceptible sheet metal wherein the portions are magnetically attracted to one another at substantially all of the interface therebetween with a sufficient force to prevent inadvertent dislodgement therefrom but insufficient to prevent the second portion from being slid away from the first portion when a player vigorously slides into the base, thereby preventing a serious injury to the player, yet allowing the player to maintain contact with at least the first portion of the base and preventing overrunning the base and being tagged "out" and further wherein, the attraction between the first portion and-the second portion is unaffected by dirt adhering to the portions.

11. A break-away base for preventing injuries to baseball players, particularly when sliding into the base, comprising:

a generally-square first portion having a top surface and four sides, each of which is bent downwardly and projects outwardly from the top surface, said first portion being formed from sheet metal, means for fixedly mounting said first portion to the ground such that the top surface of the first portion is flush with the ground level and the sides of the first portion are below the ground level, a second, generally-square portion, movably disposed on top of the first portion and substantially aligned with said first portion, said second portion having a flat bottom and four sides which are substantially perpendicular to the bottom, the bottom of the second portion carrying magnetic means thereon, said magnetic means covering substantially all of the bottom of the second portion, wherein substantially all of the bottom of the second portion is magnetically attracted to substantially all of the top surface of the first portion with a sufficient force to prevent inadvertent dislodgement therefrom but insufficient to prevent the second portion from being broken-away from the first portion when the player vigorously slides into the base, and further wherein, a foot of the player, which digs into the ground, is directed upwardly by the sides of the first portion to dislodge the second portion, thereby preventing serious injury to the player.

* * * * *